US007150372B2

(12) United States Patent
Lisch et al.

(10) Patent No.: US 7,150,372 B2
(45) **Date of Patent: *Dec. 19, 2006**

(54) CONTAINER BASE STRUCTURE RESPONSIVE TO VACUUM RELATED FORCES

(75) Inventors: G. David Lisch, Jackson, MI (US); Kerry W Silvers, Chelsea, MI (US); Dwayne G Vailliencourt, Manchester, MI (US)

(73) Assignee: Amcor Limited, Abbotsford (AU)

( * ) Notice: Subject to any disclaimer, the term of this patent is extended or adjusted under 35 U.S.C. 154(b) by 0 days.

This patent is subject to a terminal disclaimer.

(21) Appl. No.: 11/116,764

(22) Filed: Apr. 28, 2005

(65) Prior Publication Data

US 2005/0196569 A1 Sep. 8, 2005

Related U.S. Application Data

(63) Continuation of application No. 10/445,104, filed on May 23, 2003, now Pat. No. 6,942,116.

(51) Int. Cl.
*B65D 1/02* (2006.01)
*B65D 1/40* (2006.01)

(52) U.S. Cl. ..... 215/373; 215/371; 220/606; 220/609

(58) Field of Classification Search ..... 215/371, 215/373–375; 220/606, 608, 609
See application file for complete search history.

(56) References Cited

U.S. PATENT DOCUMENTS 3,409,167 A 11/1968 Blanchard
3,942,673 A 3/1976 Lyu et al.
4,174,782 A 11/1979 Obsomer
4,231,483 A 11/1980 Dechenne et al.
4,342,398 A 8/1982 Chang
4,381,061 A 4/1983 Cerny et al.
4,408,698 A 10/1983 Ballester
4,431,112 A 2/1984 Yamaguchi
4,620,639 A 11/1986 Yoshino
4,667,454 A 5/1987 McHenry et al.
5,005,716 A 4/1991 Eberle
5,217,737 A 6/1993 Gygax et al.
5,492,245 A 2/1996 Kalkanis
RE36,639 E 4/2000 Okhai
6,176,382 B1 1/2001 Bazlur Rashid
6,299,007 B1 10/2001 Takeuchi
6,595,380 B1 7/2003 Silvers
6,942,116 B1 * 9/2005 Lisch et al. ..... 215/373
2002/0153343 A1 10/2002 Tobias et al.

FOREIGN PATENT DOCUMENTS

WO WO2004/028910 4/2004

* cited by examiner

*Primary Examiner*—Sue A. Weaver
(74) *Attorney, Agent, or Firm*—Harness, Dickey & Pierce, P.L.C.

(57) ABSTRACT

A plastic container having a base portion adapted for vacuum pressure absorption. The base portion including a contact ring upon which the container is supported, an upstanding wall and a central portion. The upstanding wall being adjacent to and generally circumscribing the contact ring. The central portion being defined in at least part by a central pushup and an inversion ring which generally circumscribes the central pushup. The central pushup and the inversion ring being moveable to accommodate vacuum forces generated within the container.

28 Claims, 5 Drawing Sheets

CONTAINER BASE STRUCTURE RESPONSIVE TO VACUUM RELATED FORCES

CROSS-REFERENCE TO RELATED APPLICATION

This application is a continuation of U.S. application Ser. No. 10/445,104 filed May 23, 2003 now U.S. Pat. No. 6,942,116 and commonly assigned.

TECHNICAL FIELD OF THE INVENTION

This invention generally relates to plastic containers for retaining a commodity, and in particular a liquid commodity. More specifically, this invention relates to a panel-less plastic container having a base structure that allows for significant absorption of vacuum pressures by the base without unwanted deformation in other portions of the container.

BACKGROUND OF THE INVENTION

Numerous commodities previously supplied in glass containers are now being supplied in plastic containers, more specifically polyester and even more specifically polyethylene terephthalate (PET) containers. Manufacturers and fillers, as well as consumers, have recognized that PET containers are lightweight, inexpensive, recyclable and manufacturable in large quantities.

Manufacturers currently supply PET containers for various liquid commodities, such as beverages. Often these liquid products, such as juices and isotonics, are filled into the containers while the liquid product is at an elevated temperature, typically 68° C.–96° C. (155° F.–205° F.) and usually about 85° C. (185° F.). When packaged in this manner, the hot temperature of the liquid commodity is used to sterilize the container at the time of filling. This process is known as hot filling. The containers designed to withstand the process are known as hot fill or heat set containers.

Hot filling is an acceptable process for commodities having a high acid content. Non-high acid content commodities, however, must be processed in a different manner. Nonetheless, manufacturers and fillers of non-high acid content commodities desire to supply their commodities in PET containers as well.

For non-high acid commodities, pasteurization and retort are the preferred sterilization process. Pasteurization and retort both present an enormous challenge for manufactures of PET containers in that heat set containers cannot withstand the temperature and time demands required of pasteurization and retort.

Pasteurization and retort are both processes for cooking or sterilizing the contents of a container after it has been filled. Both processes include the heating of the contents of the container to a specified temperature, usually above about 70° C. (about 155° F.), for a specified length of time (20–60 minutes). Retort differs from pasteurization in that higher temperatures are used, as is an application of pressure externally to the container. The pressure applied externally to the container is necessary because a hot water bath is often used and the overpressure keeps the water, as well as the liquid in the contents of the container, in liquid form, above their respective boiling point temperatures.

PET is a crystallizable polymer, meaning that it is available in an amorphous form or a semi-crystalline form. The ability of a PET container to maintain its material integrity is related to the percentage of the PET container in crystalline form, also known as the "crystallinity" of the PET container. The percentage of crystallinity is characterized as a volume fraction by the equation:

$$\text{Crystallinity}\,\% = \left(\frac{\rho - \rho_a}{\rho_c - \rho_a}\right) \times 100$$

where ρ is the density of the PET material; $\rho_a$ is the density of pure amorphous PET material (1.333 g/cc); and $\rho_c$ is the density of pure crystalline material (1.455 g/cc).

The crystallinity of a PET container can be increased by mechanical processing and by thermal processing. Mechanical processing involves orienting the amorphous material to achieve strain hardening. This processing commonly involves stretching a PET preform along a longitudinal axis and expanding the PET preform along a transverse or radial axis to form a PET container. The combination promotes what is known as biaxial orientation of the molecular structure in the container. Manufacturers of PET containers currently use mechanical processing to produce PET containers having about 20% crystallinity in the container's sidewall.

Thermal processing involves heating the material (either amorphous or semi-crystalline) to promote crystal growth. On amorphous material, thermal processing of PET material results in a spherulitic morphology that interferes with the transmission of light. In other words, the resulting crystalline material is opaque, and thus, generally undesirable. Used after mechanical processing, however, thermal processing results in higher crystallinity and excellent clarity for those portions of the container having biaxial molecular orientation. The thermal processing of an oriented PET container, which is known as heat setting, typically includes blow molding a PET preform against a mold heated to a temperature of about 120° C.–130° C. (about 248° F.–266° F.), and holding the blown container against the heated mold for about three (3) seconds. Manufacturers of PET juice bottles, which must be hot filled at about 85° C. (185° F.), currently use heat setting to produce PET bottles having an overall crystallinity in the range of 25–30%.

After being hot filled, the heat set containers are capped and allowed to reside at generally about the filling temperature for approximately five (5) minutes. The container, along with the product, is then actively cooled so that the filled container may be transferred to labeling, packaging and shipping operations. Upon cooling, the volume of the liquid in the container is reduced. This product shrinkage phenomenon results in the creation of a vacuum within the container. Generally, vacuum pressures within the container range from 1–300 mm Hg less than atmospheric pressure (i.e., 759 mm Hg–460 mm Hg). If not controlled or otherwise accommodated, these vacuum pressures result in deformation of the container which leads to either an aesthetically unacceptable container or one which is unstable. Typically, vacuum pressures have been accommodated by the incorporation of structures in the sidewall of the container. These structures are commonly known as vacuum panels. Vacuum panels are designed to distort inwardly under the vacuum pressures in a controlled manner so as to eliminate undesirable deformation in the sidewall of the container.

While vacuum panels have allowed the containers to withstand the rigors of a hot fill procedure, they do present some limitations and drawbacks. First, a smooth glass-like appearance cannot be accomplished. Second, during labeling, a wrap-around or sleeve label is applied to the container over the vacuum panels. Often, the appearance of these labels over the sidewall and vacuum panels is such that the label is wrinkled and not smooth. Additionally, when grasping the container, the vacuum panels are felt beneath the label resulting in the label being pushed into the various crevasses and recesses of the vacuum panels.

Further refinements have led to the use of pinch grip geometry in the sidewall of the containers to help control container distortion resulting from vacuum pressures. However, similar limitations and drawbacks exist with pinch grip geometry as with vacuum panels.

Another way for a hot-fill plastic container to achieve the above described objectives without having vacuum accommodating structural features is through the use of nitrogen dosing technology. One drawback with this technology however is that the maximum line speeds achievable with the current technology is limited to roughly 200 containers per minute. Such slower line speeds are seldom acceptable. Additionally, the dosing consistency is not yet at a technological level to achieve efficient operations.

Thus, there is a need for an improved container which can accommodate the vacuum pressures which result from hot filling yet which mimics the appearance of a glass container having sidewalls without substantial geometry, allowing for a smooth, glass-like appearance. It is therefore an object of this invention to provide such a container.

SUMMARY OF THE INVENTION

Accordingly, this invention provides for a plastic container which maintains aesthetic and mechanical integrity during any subsequent handling after being hot filled and cooled to ambient having a base structure that allows for significant absorption of vacuum pressures by the base without unwanted deformation in other portions of the container. In a glass container, the container does not move, its structure must restrain all pressures and forces. In a bag container, the container easily moves and conforms to the product. The present invention is somewhat of a highbred, providing areas that move and areas that do not move. Ultimately, after the base portion of the plastic container of the present invention moves or deforms, the remaining overall structure of the container restrains any and all additional pressures or forces without collapse.

The present invention includes a plastic container having an upper portion, a body or sidewall portion and a base. The upper portion can include, but is not required to include, an opening defining a mouth of the container, a finish section, a threaded region and a support ring. The body portion extends from the upper portion to the base. The base includes a central portion defined in at least part by a central pushup and an inversion ring. The central pushup and the inversion ring being moveable to accommodate vacuum forces generated within the container.

Additional benefits and advantages of the present invention will become apparent to those skilled in the art to which the present invention relates from the subsequent description of the preferred embodiment and the appended claims, taken in conjunction with the accompanying drawings.

DETAILED DESCRIPTION OF THE PREFERRED EMBODIMENTS

The following description of the preferred embodiments is merely exemplary in nature, and is in no way intended to limit the invention or its application or uses.

As discussed above, to accommodate vacuum forces during cooling of the contents within a heat set container, containers have been provided with a series of vacuum panels or pinch grips around their sidewalls. The vacuum panels and pinch grips deform inwardly under the influence of the vacuum forces and prevent unwanted distortion elsewhere in the container. However, with the vacuum panels and pinch grips, the container sidewall cannot be smooth or glass-like, an overlying label is not smooth, and end users can feel the vacuum panels and pinch grips when grasping and picking up the containers.

In a vacuum panel-less container, a combination of controlled deformation (e.g. in the base or closure) and vacuum resistance in the remainder of the container is required. Accordingly, this invention provides for a plastic container which enables its base portion to deform and move easily while maintaining a rigid structure (i.e., against internal vacuum) in the remainder of the container. As an example, in a 20 oz. plastic container, the container should be able to accommodate roughly 22 cc of volume displacement. In the present plastic container, the base portion accommodates a majority of this requirement (i.e., roughly 18.5 cc). The remaining portions of the plastic container are easily able to accommodate the rest of this volume displacement.

Figure 1:
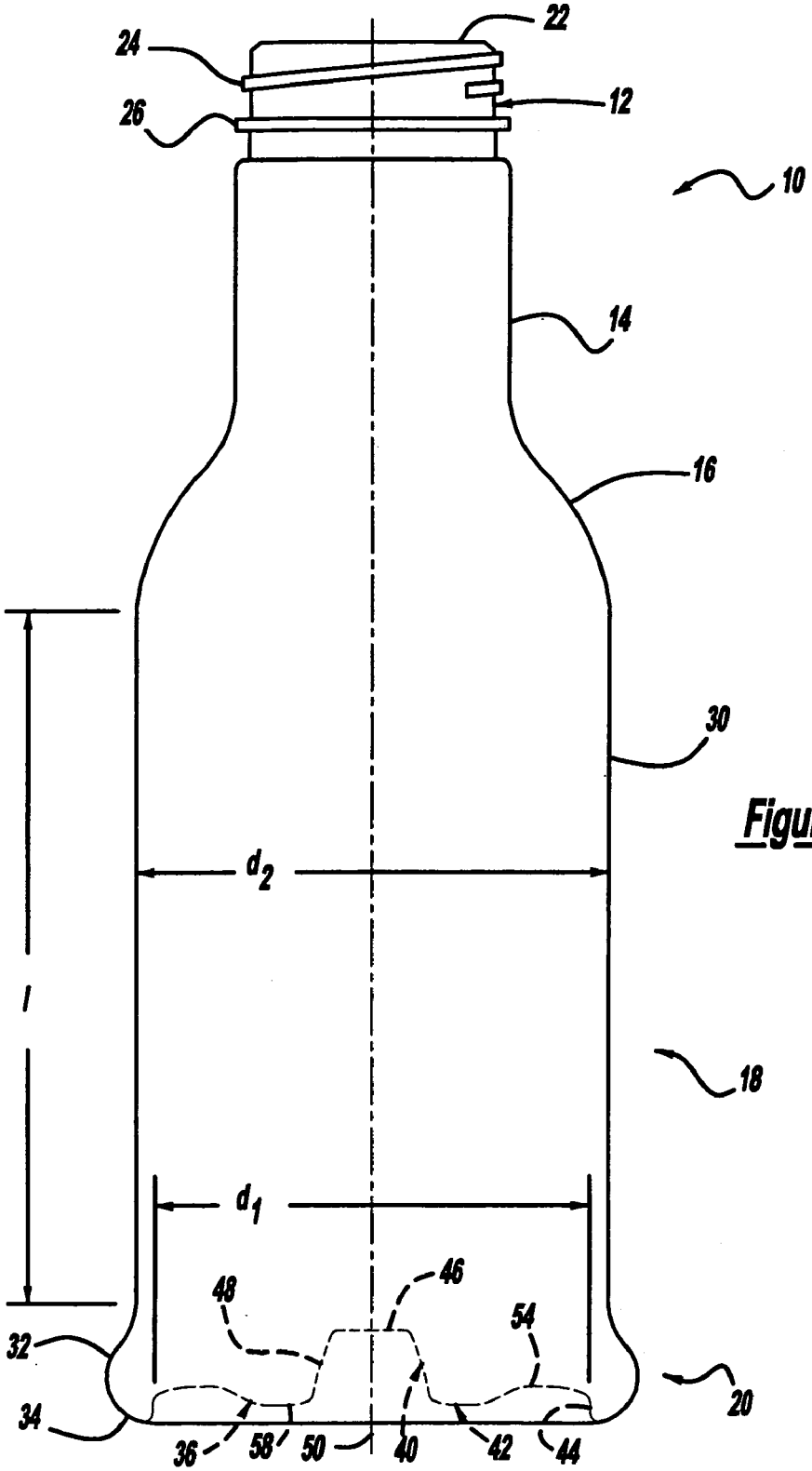
FIG. 1 is an elevational view of a plastic container according to the present invention, the container as molded and empty.
Figure 2:
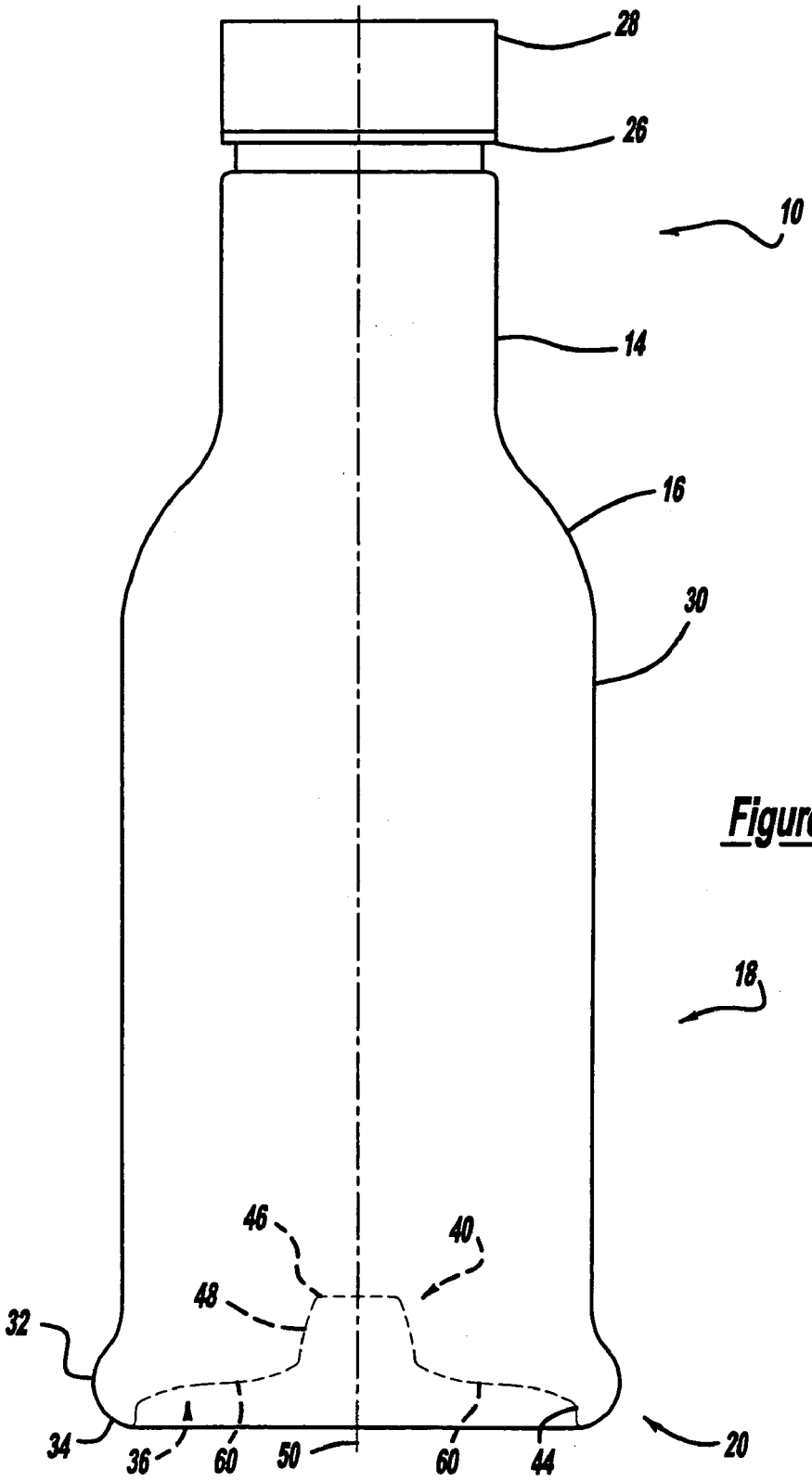
FIG. 2 is an elevational view of the plastic container according to the present invention, the container being filled and sealed.

As shown in FIGS. 1 and 2, a plastic container 10 of the invention includes a finish 12, an elongated neck 14, a shoulder region 16, a body portion 18 and a base 20. The plastic container 10 has been specifically designed for retaining a commodity during a thermal process, such as a high-temperature pasteurization or retort. The plastic container 10 may be used for retaining a commodity during other thermal processes as well.

The plastic container 10 of the present invention is a blow molded, biaxially oriented container with an unitary construction from a single or multi-layer material such as polyethylene terephthalate (PET) resin. Alternatively, the plastic container 10 may be formed by other methods and from other conventional materials including, for example, polyethylene napthalate (PEN), and a PET/PEN blend or copolymer. Plastic containers blow molded with an unitary construction from PET materials are known and used in the art of plastic containers, and their general manufacture in the present invention will be readily understood by a person of ordinary skill in the art.

The finish 12 of the plastic container 10 includes a portion defining an aperture or mouth 22, a threaded region 24 and a support ring 26. The aperture 22 allows the plastic container 10 to receive a commodity while the threaded region 24 provides a means for attachment of a similarly threaded closure or cap 28 (shown in FIG. 2). Alternatives may include other suitable devices which engage the finish 12 of the plastic container 10. Accordingly, the closure or cap 28 functions to engage with the finish 12 so as to preferably provide a hermetical seal for the plastic container 10. The closure or cap 28 is preferably made from a plastic or metal material conventional to the closure industry and suitable for subsequent thermal processing, including high temperature pasteurization and retort. The support ring 26 may be used to carry or orient the preform (the precursor to the plastic container 10) (not shown) through and at various stages of manufacture. For example, the preform may be carried by the support ring 26, the support ring 26 may be used to aid in positioning the preform in the mold, or the support ring 26 may be used by an end consumer to carry the plastic container 10.

The neck 14 of the plastic container 10 is elongated, enabling the plastic container 10 to accommodate volume requirements. Integrally formed with the elongated neck 14 and extending downward therefrom is the shoulder region 16. The shoulder region 16 merges into and provides a transition between the elongated neck 14 and the body portion 18. The body portion 18 extends downward from the shoulder region 16 to the base 20 and includes sidewalls 30. Because of the specific construction of the base 20 of the container 10, the sidewalls 30 for the heat set container 10 are formed without the inclusion therein of vacuum panels or pinch grips and are generally smooth and glass-like. A significantly light weight container can be formed by including sidewalls having vacuum panels and/or pinch grips along with the base 20.

Figure 5:
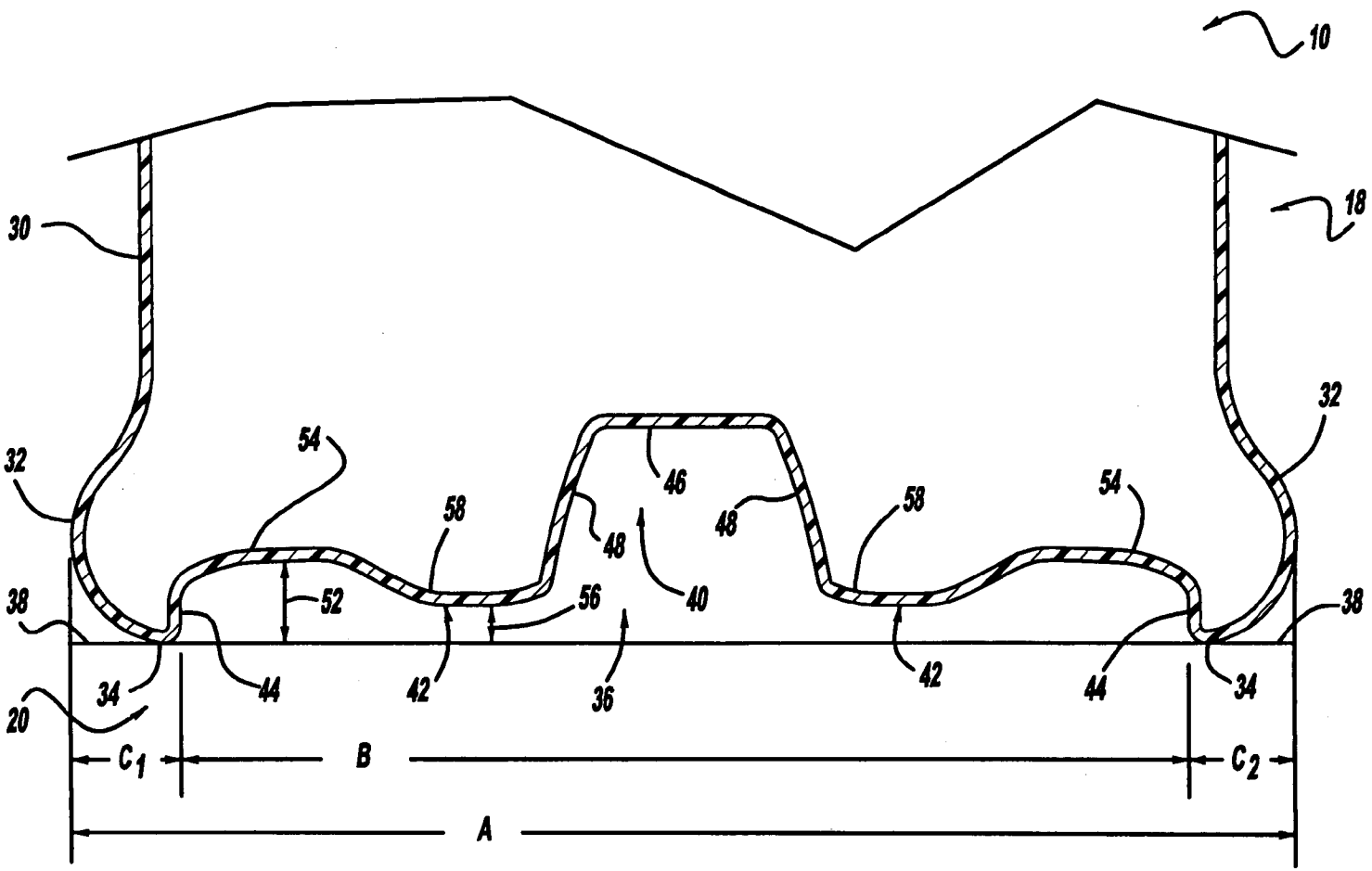
FIG. 5 is a cross-sectional view of the plastic container, taken generally along line 5—5 of FIG. 3.
Figure 6:
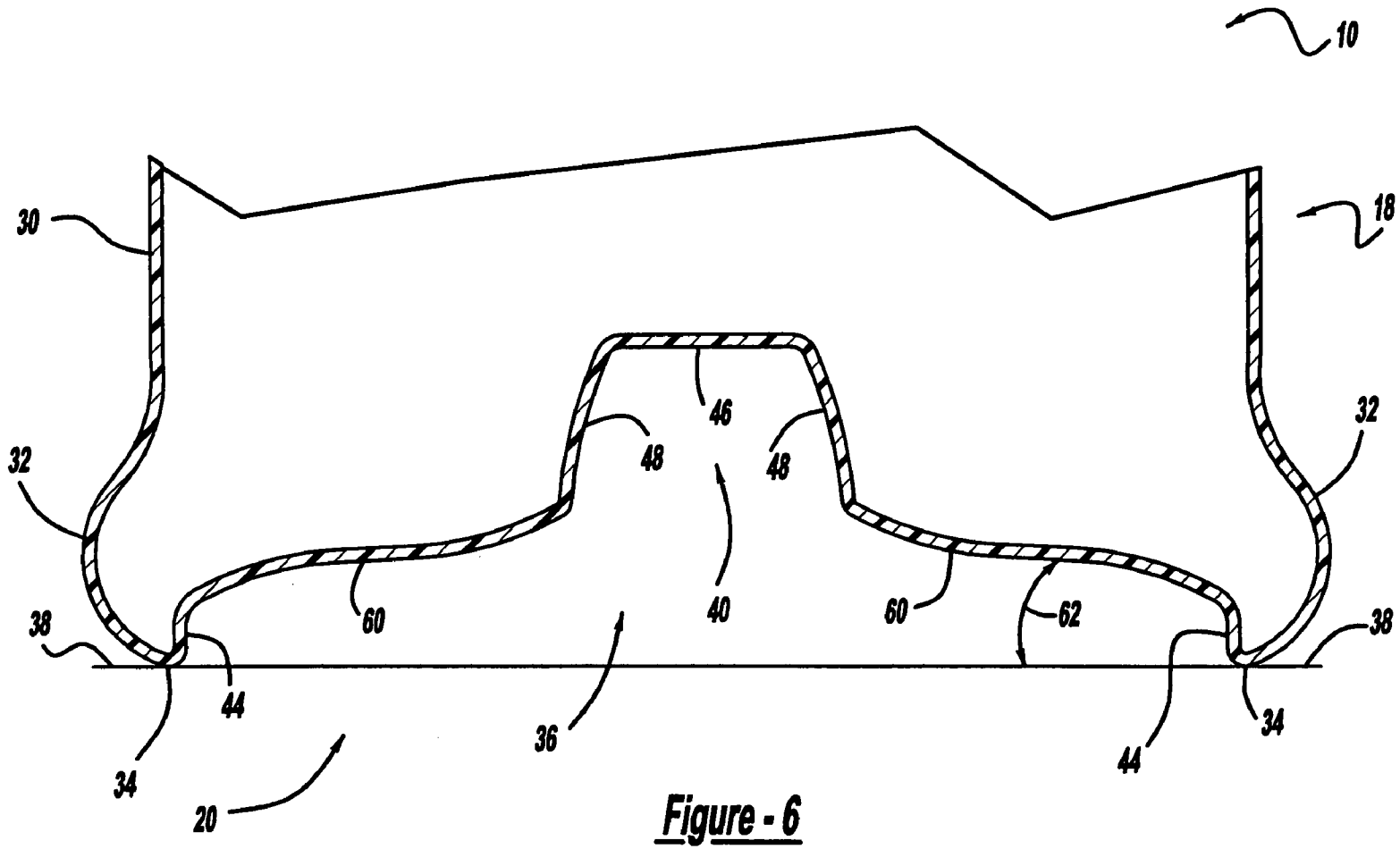
FIG. 6 is a cross-sectional view of the plastic container, taken generally along line 6—6 of FIG. 4.

The base 20 of the plastic container 10, which generally extends from the body portion 18, generally includes a chime 32, a contact ring 34 and a central portion 36. As illustrated in FIGS. 5 and 6, the contact ring 34 is itself that portion of the base 20 which contacts a support surface 38 upon which the container 10 is supported. As such, the contact ring 34 may be a flat surface or a line of contact generally circumscribing, continuously or intermittently, the base 20. The base 20 functions to close off the bottom portion of the plastic container 10 and, together with the elongated neck 14, the shoulder region 16 and the body portion 18, to retain the commodity.

The plastic container 10 is preferably heat set according to the above mentioned process or other conventional heat set processes. To accommodate vacuum forces and allow for the omission of vacuum panels and pinch grips in the body portion 18 of the container 10, the base 20 of the present invention adopts a novel and innovative construction. Generally, the central portion 36 of the base 20 is provided with a central pushup 40 and an inversion ring 42. Additionally, the base 20 includes an upstanding circumferential wall or edge 44 which forms a transition between the inversion ring 42 and the contact ring 34.

As shown in FIGS. 1–6, the central pushup 40, when viewed in cross section, is generally in the shape of a truncated cone having a top surface 46 which is generally substantially parallel to the support surface 38 and side surfaces 48 which are generally planar and slope upward toward a central longitudinal axis 50 of the container 10. The exact shape of the central pushup 40 can vary greatly depending on various design criteria. However, in general, the diameter of the central pushup 40 is at most 30% of the overall diameter of the base 20. The central pushup 40 is generally where the gate of the preform is captured in the mold and is the portion of the base 20 of the container 10 that is not substantially oriented.

Figure 3:
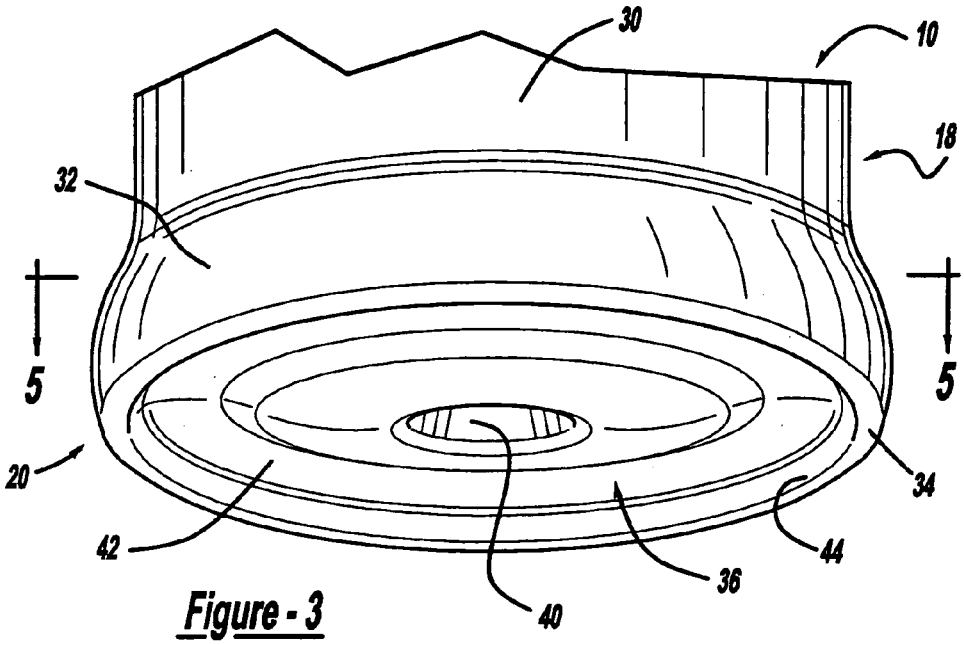
FIG. 3 is a bottom perspective view of a portion of the plastic container of FIG. 1.

As shown in FIGS. 3 and 5, when initially formed, the inversion ring 42 is molded as a ring that completely surrounds and circumscribes the central pushup 40 having a gradual radius. As formed, the inversion ring 42 protrudes outwardly, below a plane where the base 20 would lie if it was flat. When viewed in cross section (see FIG. 5), the inversion ring 42 is generally "S" shaped. The transition between the central pushup 40 and the adjacent inversion ring 42 must be rapid in order to promote as much orientation as near the central pushup 40 as possible. This serves primarily to ensure a minimal wall thickness for the inversion ring 42 of the base 20. Typically, the wall thickness of the inversion ring 42 is approximately between about 0.008 inches (0.203 mm) to about 0.025 inches (0.635 mm). The wall thickness of the inversion ring 42 must be thin enough to allow the inversion ring 42 to be flexible and function properly. At a point along its circumventional shape, the inversion ring 42 may alternatively feature a small indentation, not illustrated but well known in the art, suitable for receiving a pawl that facilitates container rotation about the central longitudinal axis 50 during a labeling operation.

The circumferential wall or edge 44, defining the transition between the contact ring 34 and the inversion ring 42, is an upstanding wall approximately 0.030 inches (0.762 mm) to approximately 0.180 inches (4.572 mm) in height for a 2.75 inch (69.85 mm) diameter base container, approximately 0.050 inches (1.27 mm) to approximately 0.325 inches (8.255 mm) in height for a 5 inch (127 mm) diameter base container, or of such a similar proportion, and is generally seen as being parallel to the central longitudinal axis 50 of the container 10. While the circumferential wall or edge 44 need not be exactly parallel to the central longitudinal axis 50, it should be noted that the circumferential wall or edge 44 is a distinctly identifiable structure between the contact ring 34 and the inversion ring 42. The circumferential wall or edge 44 provides strength to the transition between the contact ring 34 and the inversion ring 42. This transition must be abrupt in order to maximize the local strength as well as to form a geometrically rigid structure. The resulting localized strength increases the resistance to creasing in the base 20.

Figure 4:
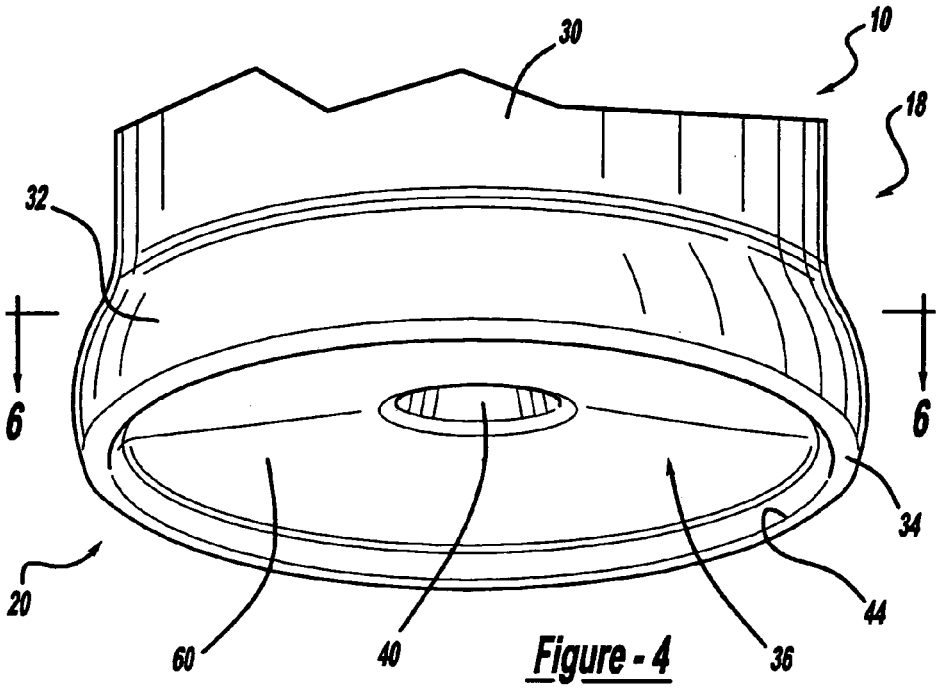
FIG. 4 is a bottom perspective view of a portion of the plastic container of FIG. 2.

When initially formed, the central pushup 40 and the inversion ring 42 remain as described above and shown in FIGS. 1, 3 and 5. Accordingly, as molded, a dimension 52 measured between an upper portion 54 of the inversion ring 42 and the support surface 38 is greater than or equal to a dimension 56 measured between a lower portion 58 of the inversion ring 42 and the support surface 38. Upon filling, the central portion 36 of the base 20 and the inversion ring 42 will slightly sag or deflect downward toward the support surface 38 under the temperature and weight of the product. As a result, the dimension 56 becomes almost zero, that is, the lower portion 58 of the inversion ring 42 is practically in contact with the support surface 38. Upon capping, sealing and cooling, as shown in FIGS. 2, 4 and 6, the central pushup 40 and the inversion ring 42 are raised or pulled upward, displacing volume, as a result of vacuum forces. In this position, the central pushup 40 generally retains its truncated cone shape in cross section with the top surface 46 of the central pushup 40 remaining substantially parallel to the support surface 38. However, the inversion ring 42 is incorporated into the central portion 36 of the base 20 and virtually disappears, becoming more conical in shape. Accordingly, upon capping, sealing and cooling the container 10, the central portion 36 of the base 20 exhibits more of a conical shape having surfaces 60 which are generally planar and slope upward toward the central longitudinal axis 50 of the container 10, as shown in FIG. 6. This conical shape and the generally planar surfaces 60 may be defined at an angle 62 of about 0° to about 15° relative to a horizontal plane or the support surface 38. The greater the dimension 52 and the smaller the dimension 56, the greater the achievable displacement of volume.

The amount of volume which the central portion 36 of the base 20 displaces is also dependant on the projected surface area of the central portion 36 of the base 20 as compared to the projected total surface area of the base 20. In order to eliminate the necessity of providing vacuum panels or pinch grips in the body portion 18 of the container 10, the central portion 36 of the base 20 is provided with a projected surface area of approximately 55%, and preferably greater than approximately 70%, of the total projected surface area of the base 20. As illustrated in FIG. 5, the relevant projected linear lengths across the base 20 are identified as A, B, $C_1$ and $C_2$. The projected total surface area of the base 20 ($PSA_A$) is defined by the equation:

$$PSA_A=\pi(\tfrac{1}{2}A)^2.$$

Accordingly, for a container having a 2.75 inch (69.85 mm) diameter base, the projected total surface area ($PSA_A$) is 5.94 in.$^2$ (150.88 mm$^2$). The projected surface area of the central portion 36 of the base 20 ($PSA_B$) is defined by the equation:

$$PSA_B=\pi(\tfrac{1}{2}B)^2$$

where $B=A-C_1-C_2$. For a container having a 2.75 inch (69.85 mm) diameter base, the length of the chime 32 ($C_1$ and $C_2$) is generally in the range of approximately 0.030 inches (0.762 mm) to 0.36 inches (9.144 mm). Accordingly, the B dimension is generally in the range of approximately 2.03 inches (51.56 mm) to 2.69 inches (68.33 mm). Therefore, the projected surface area for the central portion 36 of the base 20 ($PSA_B$) is generally in the range of approximately 3.23 in.$^2$ (82.04 mm$^2$) to 5.68 in.$^2$ (144.27 mm$^2$). Thus, by way of example, the projected surface area of the central portion 36 of the base 20 ($PSA_B$) for a 2.75 inch (69.85 mm) diameter base container is generally in the range of approximately 54% to 96% of the projected total surface area of the base 20 ($PSA_A$). The greater this percentage, the greater the amount of vacuum the container 10 can accommodate without unwanted deformation in other areas of the container 10.

Pressure acts in an uniform manner on the interior of a plastic container that is under vacuum. Force, however, will differ based on geometry (i.e., surface area). Thus, the pressure in a container having a cylindrical cross section is defined by the equation:

$$P=\frac{F}{A}$$

where F represents force in pounds and A represents area in inches squared. As illustrated in FIG. 1, the diameter of the central portion 36 of the base 20 is identified as $d_1$. While the diameter of the body portion 18 is identified as $d_2$. Continuing with FIG. 1, the height of the body portion 18, from the bottom of the shoulder region 16 to the top of the chime 32, the smooth label panel area of the plastic container 10, is identified as I. As set forth above, it is well known that added geometry (e.g. ribs) in the body portion 18 will have a stiffening effect. The below analysis considers only those portions of the container that do not have such geometry.

According to the above, the pressure associated with the central portion 36 of the base 20 ($P_B$) is defined by the equation:

$$P_B=\frac{F_1}{A_1}$$

where $F_1$ represents the force exerted on the central portion 36 of the base 20 and $$P_{BP}=\frac{F_2}{A_2}$$

the area associated with the central portion 36 of the base 20. Similarly, the pressure associated with the body portion 18 ($P_{BP}$) is defined by the equation:

$$A_1=\frac{\pi d_1^2}{4},$$

where $F_2$ represents the force exerted on the body portion 18 and $A_2=\pi d_2 l$, the area associated with the body portion 18. Thus, a force ratio between the force exerted on the body portion 18 of the container 10 compared to the force exerted on the central portion 36 of the base 20 is defined by the equation:

$$\frac{F_2}{F_1}=\frac{4d_2 l}{d_1^2}.$$

For optimum performance, the above force ratio should be less than 10, with lower ratio values being most desirable.

As set forth above, the difference in wall thickness between the base 20 and the body portion 18 of the container 10 is also of importance. The wall thickness of the body portion 18 must be large enough to allow the inversion ring 42 to flex properly. As the above force ratio approaches 10, the wall thickness in the base 20 of the container 10 is required to be much less than the wall thickness of the body portion 18. Depending on the geometry of the base 20 and the amount of force required to allow the inversion ring 42 to flex properly, that is, the ease of movement, the wall thickness of the body portion 18 must be at least 15%, on average, greater than the wall thickness of the base 20. A greater difference is required if the container must withstand higher forces either from the force required to initially cause the inversion ring 42 to flex or to accommodate additional applied forces once the base 20 movement has completed.

The following table is illustrative of numerous containers which exhibit the above-described principles and concepts.

| | Container Size | | | |
|---|---|---|---|---|
| | 20 oz (I) | 20 oz (II) | 20 oz (III) | 16 oz |
| $d_1$ (inches) | 2.509 | 2.4 | 2.485 | 2.4 |
| $d_2$ (inches) | 2.758 | 2.821 | 2.689 | 2.881 |

-continued

| | Container Size | | | |
|---|---|---|---|---|
| | 20 oz (I) | 20 oz (II) | 20 oz (III) | 16 oz |
| I (inches) | 2.901 | 4.039 | 2.669 | 3.211 |
| $A_1$ (inches$^2$) | 4.9 | 4.5 | 4.9 | 4.5 |
| $A_2$ (inches$^2$) | 25.1 | 35.8 | 22.5 | 29.1 |
| Force Ratio | 5.08 | 7.91 | 4.65 | 6.42 |
| Base (20) Wall Thickness (mils) | 22 | 15 | 20 | 20 |
| Body Portion (18) Wall Thickness (mils) | 26 | 26 | 26 | 32 |
| Body Portion (18) Wall Thickness Must Be At Least X % Greater Than Base (20) Wall Thickness | 38 | 43 | 23 | 16 |

In all of the above illustrative examples, the bases of the container function as the major deforming mechanism of the container. Additionally, as the force ratio increases, the required base wall thickness decreases. Moreover, the body portion (18) wall thickness to the base (20) wall thickness comparison is dependent in part on the force ratios and container geometry. A similar analysis can be undertaken for containers having non-cylindrical cross-sections (i.e., "tround" or square) with similar results.

Accordingly, the thin, flexible, curved, generally "S" shaped geometry of the inversion ring 42 of the base 20 of the container 10 allows for greater volume displacement versus containers having a substantially flat base.

In an alternative embodiment, in order to improve aesthetics, the chime is not flared out. In such a container, the body portion, chime and base flow together more evenly and consistently. The container in such an alternative embodiment provides a more conventional visual impression.

In another alternative embodiment, in order to improve functionality, a container includes a more prominent flared out chime. Under vacuum pressure, the flared out chime imperceptibly deforms inward, adding to the volume displacement capability of the container and further strengthening the outer edge of the base of the container.

While the above description constitutes the preferred embodiment of the present invention, it will be appreciated that the invention is susceptible to modification, variation and change without departing from the proper scope and fair meaning of the accompanying claims.

What is claimed is:

1. A plastic container having a base portion adapted for vacuum absorption, said container comprising:

an upper portion having a mouth defining an opening into said container, an elongated neck extending from said upper portion, a body portion extending from said elongated neck to a base, said base closing off an end of said container; said upper portion, said elongated neck, said body portion and said base cooperating to define a receptacle chamber within said container into which product can be filled; said base including a chime extending from said body portion to a contact ring which defines a surface upon which said container is supported, said base further including a central portion defined in at least part by a pushup located on a longitudinal axis of said container and an inversion ring circumscribing said pushup, said inversion ring defining an inwardly domed shaped portion when said container is filled and sealed, said inwardly domed shaped portion defined by a surface which is sloped toward said longitudinal axis of said container at an angle in a range of about 7° to about 15° relative to a support surface, said pushup and said inversion ring being moveable to accommodate vacuum forces generated within said container.

2. The container of claim 1 wherein said body portion includes a substantially smooth sidewall.

3. The container of claim 1 wherein said pushup is generally truncated cone shaped in cross section.

4. The container of claim 1 wherein said inversion ring has a wall thickness between about 0.008 inches (0.203 mm) to about 0.025 inches (0.635 mm).

5. The container of claim 3 wherein said pushup has a top surface which is generally parallel to said support surface when said container is formed, and after said container is filled and sealed.

6. The container of claim 3 wherein said pushup has a diameter which is equal to at most 30% of an overall diameter of said base.

7. The container of claim 1 wherein a ratio between a force exerted on said base compared to a force exerted on said body portion is less than 10.

8. The container of claim 1 wherein said body portion has a wall thickness and said base has a wall thickness, said body portion wall thickness being at least 15% greater than said base wall thickness.

9. The container of claim 1 wherein said inversion ring has a first portion and a second portion, wherein a first distance between said first portion and said support surface is greater than a second distance between said second portion and said support surface.

10. A plastic container having a base portion adapted for vacuum absorption, said container comprising:

an upper portion having a mouth, and a body portion extending from said upper portion to a base, said base closing off a bottom of said container; said upper portion, said body portion and said base cooperating to define a chamber into which product can be filled; said base including a contact ring upon which said container is supported, an upstanding wall and a central portion; said upstanding wall being adjacent to and generally circumscribing said contact ring; said central portion being defined in at least part by a pushup located on a longitudinal axis of said container and an inversion ring extending from said upstanding wall and circumscribing said pushup, said inversion ring defining an inwardly domed shaped portion when said container is filled and sealed, said inwardly domed shaped portion defined by a surface which is sloped toward said longitudinal axis of said container at an angle in a range of about 7° to about 15° relative to a support surface, said pushup and said inversion ring being moveable to accommodate vacuum forces generated within said container.

11. The container of claim 10 wherein said upstanding wall is generally parallel with said longitudinal axis of said container.

12. The container of claim 10 wherein said upstanding wall is immediately adjacent to said contact ring.

13. The container of claim 10 wherein said upstanding wall transitions from said contact ring at a substantially sharp corner.

14. The container of claim 10 wherein said upstanding wall has a height of at least 0.030 inches (0.762 mm).

15. The container of claim 10 wherein said upstanding wall has a height of about 0.180 inches (4.572 mm).

16. The container of claim 10 wherein said body portion includes a substantially smooth sidewall.

17. The container of claim 10 wherein said inversion ring has a wall thickness between about 0.008 inches (0.203 mm) to about 0.025 inches (0.635 mm).

18. The container of claim 10 wherein a ratio between a force exerted on said base compared to a force exerted on said body portion is less than 10.

19. The container of claim 10 wherein said body portion has a wall thickness and said base has a wall thickness, said body portion wall thickness being at least 15% greater than said base wall thickness.

20. The container of claim 10 wherein said inversion ring has a first portion and a second portion, wherein a first distance between said first portion and said support surface is greater than a second distance between said second portion and said support surface.

21. A container adapted for accommodating vacuum absorption, said container comprising:

an upper portion having a mouth defining an opening;

a substantially smooth sidewall cooperating with said upper portion; and a base portion cooperating with said sidewall, said base portion having a central pushup and an inversion ring circumscribing said central pushup, said inversion ring defining an inwardly domed shaped portion when said container is filled and sealed, said inwardly domed shaped portion defined by a surface which is sloped toward a longitudinal axis of said container at an angle in a range of about 7° to about 15° relative to a support surface, said central pushup and said inversion ring being upwardly moveable along said longitudinal axis, said movement being in response to changes in pressure in said container.

22. The container of claim 21 wherein said inversion ring has a wall thickness between about 0.008 inches (0.203 mm) to about 0.025 inches (0.635 mm).

23. The container of claim 21 wherein said central pushup has a diameter which is equal to at most 30% of an overall diameter of said base.

24. The container of claim 21 wherein said inversion ring has a first portion and a second portion, wherein a first distance between said first portion and said support surface is greater than a second distance between said second portion and said support surface.

25. The container of claim 21 wherein a ratio between a force exerted on said base portion compared to a force exerted on said sidewall is less than 10.

26. The container of claim 21 wherein said sidewall has a wall thickness and said base portion has a wall thickness, said sidewall wall thickness being at least 15% greater than said base portion wall thickness.

27. The container of claim 21 wherein said central pushup is generally truncated cone shaped in cross section.

28. The container of claim 21 wherein said central pushup has a top surface which is generally parallel to said support surface when said container is formed, and after said container is filled and sealed.

* * * * *

UNITED STATES PATENT AND TRADEMARK OFFICE

CERTIFICATE OF CORRECTION

PATENT NO. : 7,150,372 B2
APPLICATION NO. : 11/116764
DATED : December 19, 2006
INVENTOR(S) : Lisch et al.

It is certified that error appears in the above-identified patent and that said Letters Patent is hereby corrected as shown below:

Column 8, line 15 " $P_{BP} = \frac{F_2}{A_2}$ " should be -- $A_1 = \frac{\pi d_1^2}{4}$ --

Column 8, line 25 " $A_1 = \frac{\pi d_1^2}{4}$ " should be -- $P_{BP} = \frac{F_2}{A_2}$ --

Signed and Sealed this

Fifteenth Day of July, 2008

JON W. DUDAS
*Director of the United States Patent and Trademark Office*